United States Patent [19]

Ott

[11] 3,999,574

[45] Dec. 28, 1976

[54] HYDRAULIC SAFETY STOP-VALVE

[75] Inventor: Joseph Ott, Lacq, France

[73] Assignee: Societe Nationale des Petroles d'Aquitaine, Courbevoie, France

[22] Filed: Nov. 25, 1974

[21] Appl. No.: 526,954

[30] Foreign Application Priority Data

Oct. 28, 1974 France ..... 74.36015
Feb. 6, 1974 France ..... 74.03894

[52] U.S. Cl. ..... 137/629; 166/72; 166/324

[51] Int. Cl.[2] ..... E21B 33/00

[58] Field of Search ..... 251/61, 61.1, 62, 63.5, 251/63.6; 166/72, 73, 224 R, 224 A; 137/496,629

[56] References Cited

UNITED STATES PATENTS

| | | | |
|---|---|---|---|
| 2,373,034 | 4/1945 | Laird et al. | 166/224 A |
| 3,040,811 | 6/1962 | Pistole et al. | 166/72 |
| 3,071,151 | 1/1963 | Sizer | 166/224 A |
| 3,078,923 | 2/1963 | Tausch | 166/224 A |
| 3,090,443 | 5/1963 | Bostock | 166/224 A |
| 3,845,818 | 11/1974 | Deaton | 166/224 A |
| 3,865,141 | 2/1975 | Young | 166/224 R |

*Primary Examiner*—Martin P. Schwadron
*Assistant Examiner*—G. L. Walton
*Attorney, Agent, or Firm*—Brisebois & Kruger

[57] ABSTRACT

A hydraulic safety stop-valve fitted with hermetic sealing means.

The equalization passage between pressures above and below the stop-valve comprises two means of sealing, one provided by contact between two truncated conical bearing surfaces on the outer casing and inner tube, and the other consisting of valves, held by springs against the equalization passage inlet apertures, bored in the lower tubular element of the outer casing, and the opening of which is controlled by a truncated conical surface on the inner tube.

This device ensures a high level of safety in stop-valves used in large production tubings for wells at sea.

3 Claims, 3 Drawing Figures

HYDRAULIC SAFETY STOP-VALVE

Figure 1:
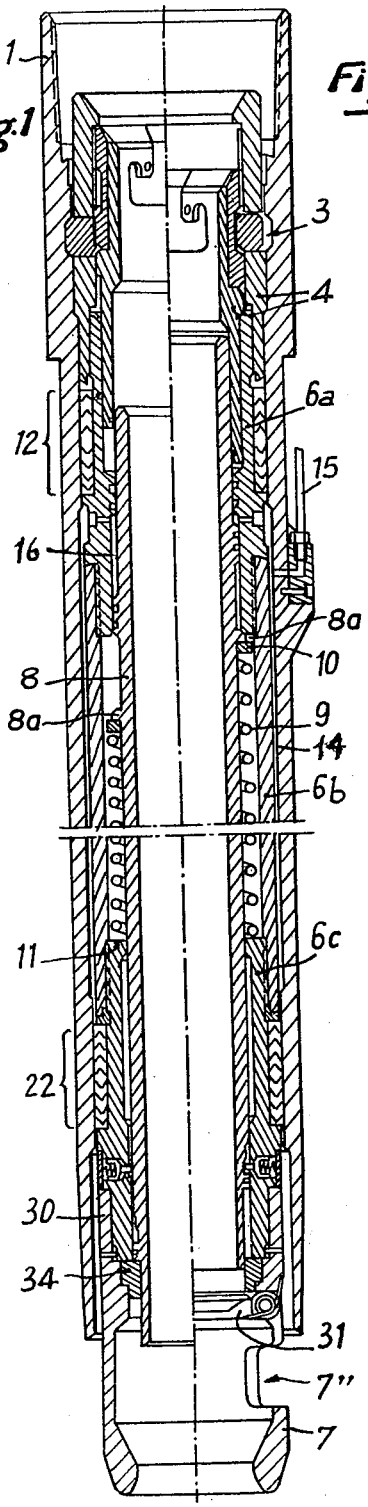

This invention concerns a hydraulic safety stop-valve for wells for extracting high pressure fluid, in which the device to equalize pressures above and below the stop-valve comprises two separate safety systems.

Various types of hydraulic safety valves already exist for use in production tubings of normal inside diameters, namely up to 150 millimeters.

When the well has to be shut urgently, this is done either by lowering a flap-valve, or by rotating a spherical throttle. Flap-valves require simpler mechanical devices than spherical throttles, so that they are recommended where the difficult problems raised by gas wells are involved, namely high pressures, very large outputs, and corrosive effluents.

The need for a hydraulic safety stop-valve for deep-sea gas wells with very large output, namely those with production tubing more than 150 mm in diameter, has led to the introduction of a hydraulically controlled flap-valve, fitted with an equalization device ensuring maximum safety.

The various existing types of hydraulic safety valves contain a single means of sealing on the equalization passage, normally consisting of a circular bearing surface, with approximately the same diameter as the valve. This means that it is not possible to attribute responsibility for continuing pressure above the valve, after it has been shut, to imperfect closure of the flap-valve or a leak in the equalization device.

A hydraulic safety stop-valve fitted with the equalization device described in this invention, which involves two separate means of sealing on the equalization passage, ensures the lowest possible risk of leakage, and allows a leak to be located if it is attributable to the first means of sealing, whether the main valve leaks or not, and allows an assessment of the origin of any abnormal pressure-rise above the stop-valve. The simplicity of the mechanisms involved also means a significant reduction in the length and weight of the stop-valve, compared with other models, so that it can still be lowered by a steel wire, for fixing into tubings of more than 150 mm in diameter.

This new hydraulic safety stop-valve for a well containing high-pressure fluid is suspended inside a tube coupling, by means of an anchoring tool, and comprises:

— an outside casing, with two seals on each side of an aperture in the upper part of the casing, to allow a hydraulic control fluid to pass;

— a valve-cage, attached to the bottom of the outer casing, and containing a flap-valve, mobile on a horizontal axis and fitted with a release spring and valve-seat;

— an inner tube, sliding inside the outer casing and comprising a thickened section forming a piston, which cooperates with a recessed section in the upper part of the outer casing, thereby forming a hydraulic chamber, into the top of which opens the aperture for the passage of the hydraulic control fluid, the outer casing and inner tube each being equipped with stops, on which a spring to release the inner tube rests, this spring being situated in a space between the outer casing and inner tube, which forms part of the passage to equalize pressures above and below the stop-valve, between at least one aperture in the lower part of the outer casing and at least one aperture in the inner tube;

this stop-valve being characterized by the fact that the pressure-equalization passage comprises two seals, one consisting of contact between two truncated conical bearing surfaces forming an integral part of the outer casing and inner tube respectively, and the other consisting of means of controlled closure of the aperture or apertures in the lower part of the outer casing.

In one recommended embodiment, the means of controlled closure of the aperture or apertures in the lower part of the outer casing consist of the combination of a valve, held by a spring against a seat in each of the equalization apertures in the lower part of the outer casing, and more specifically of a rigid needle extending from the valve through the aperture, with a truncated conical surface on the outside of the inner tube, the first part of the movement of this inner tube, from the "valve shut" to the "valve open" position, causing progressive opening of the equalization aperture or apertures.

In various embodiments, the extent of movement of the inner tube is such that, in the "open" position, the bottom of the tube penetrates into the valve-cage, by an amount corresponding to between approximately a quarter and half the length of the cage, thus holding the flap-valve against the cage.

It will be easier to understand the invention from the following description of one possible embodiment, with reference to the accompanying drawings.

Figure 2:
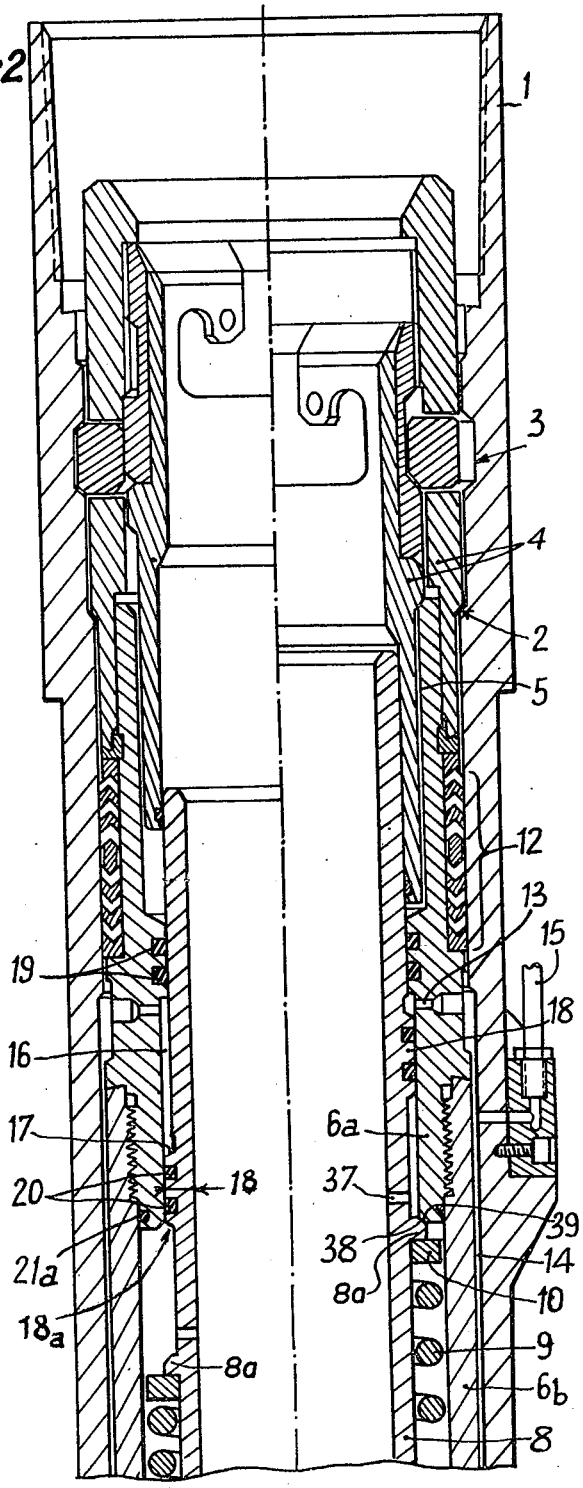
Figure 3:
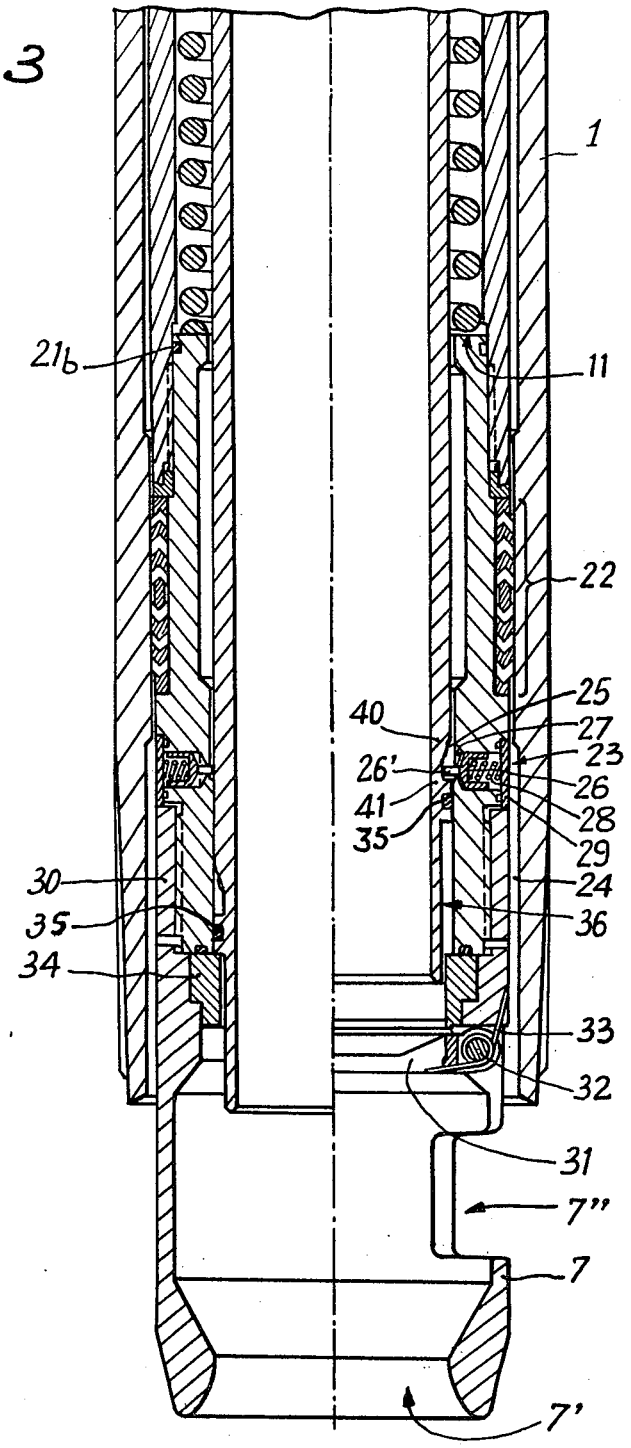

FIG. 1 shows the whole stop-valve; FIG. 2 is a detailed view of the upper half; FIG. 3 is a detailed view of the lower half.

The various figures are divided vertically into two halves, with a cross-sectional view of the stop-valve in the closed position on the right and in the open position on the left.

FIG. 1 shows a coupling in a line of tubing, forming the receptacle for the safety stop-valve and containing a positioning seat 2 and anchoring groove 3, into which an anchoring tool 4, which is known per se, can be positioned and anchored. This tool is attached to the safety valve by means of a right-hand screw-thread 5.

The anchoring tool illustrated in the figure is given as an example. Any other type of tool can be used, provided that part of it is equipped with means of attachment compatible with those on the stop-valve, and that the tube connection forming a receptacle for the valve comprises means of positioning and anchoring compatible with those on the anchoring tool.

The stop-valve, as illustrated in FIGS. 1, 2 and 3, comprises an outer casing 6, an assembly of three elements, upper **6*a*, middle 6*b* and lower 6*c*, to the bottom of which is attached a valve-cage 7, and within which slides an inner tube 8. It also comprises a spring 9 (the inner tube release spring) resting on a stop-ring 10 supported by an annular thicker section 8*a* in the inner tube 8, and on a seat 11** forming part of the outer casing.

Any other arrangement can be adopted for the outer casing 6, provided it allows removal and maintenance of the different mechanical parts of the stop-valve, while retaining the special features of the equalization passage, as described in the present invention.

In FIG. 2, the upper element **6*a* contains a set of double-action sealing rings 12, attached to the outer perimeter of the element immediately above an aperture 13**, through which the hydraulic valve-control fluid can pass.

This aperture 13 opens out of the stop-valve into a space 14 between the stop-valve and its receptacle, which space communicates by means of a hydraulic duct 15 arranged in the material of the receptacle and extending outside it, with hydraulic monitoring means at the surface (not shown here). Inside the stop-valve, the aperture opens into a space 16, the hydraulic chamber, bounded at the top by a reduction in the inside diameter of the casing 6 and at the bottom by an increase in the outer diameter of the inner tube 8; this increase in the outer diameter of the inner tube constitutes the effective surface-area 17 of the piston 18.

Above the hydraulic chamber 16 is a double sealing ring 19, located in a groove in the inner surface of the upper element, above the aperture 13, and below the hydraulic chamber 16 is another double sealing ring 20, located in a groove in the outer wall of the inner tube, in the thickened section forming the piston 18.

The middle element 6*b* consists of a cylindrical sleeve, screwed on to the upper and lower elements, with sealing rings 21*a* and 21*b* at the top of each threaded section.

The lower element 6*c* comprises a set of double-action sealing rings 22, on the outer perimeter of the element, immediately above a number of apertures 23, which are the inlets to a passage for equalizing pressure above and below the stop-valve. Each aperture 23 opens into a space 24 between the valve and its receptacle, which communicates directly with the well below the valve, and into a space 25 between the inside perimeter of the lower element 6*c* and the outer perimeter of the inner tube 8. Each aperture contains a valve 26, held on its seat 27 by one end of a spring 28, the other end of which rests against a ring 29 fitted to the lower element. A rigid needle 26′ extends from each valve through the aperture, with its end resting on the outer perimeter of the inner tube 8.

A valve-cage 7 is screwed on to the bottom of the lower element 6c by means of a sleeve 30, which prevents the ring 29 from moving sideways. A flap-valve 31, which can rotate on a horizontal axis 32, with a release spring 33 and valve-seat 34, is fitted to the cage 7, which presents a lower axial opening 7′ with a smaller diameter than that of the flap-valve, and a side opening 7″, allowing the valve to pass.

The inner tube 8, sliding inside the outer casing, is kept in hermetic contact with it by two sealing rings 19, in grooves in the inner surface of the upper element, above the aperture 13, by two sealing rings 20, in grooves in the outer surface of the piston section 18 of the inner tube, and finally by a sealing ring 35, in a groove in the outer surface of the inner tube and resting on the lower part of the lower element 6*c*, below the equalization apertures 23. The outer diameter of the lower section 36 of the inner tube 8 is reduced, so that it can slide through the valve-seat 34.

Between the piston 18 and annular thickened section 8*a*, the inner tube contains an aperture 37 for the pressure-equalization passage.

When the stop-valve is closed, a truncated conical surface 38 on the annular thickened section 8*a* of the inner tube 8 is in contact with a truncated conical bearing surface 39 on the upper element 6*a*. Contact between these annular surfaces 38 and 39 provides one of the seals blocking the equalization passage when the stop-valve is closed.

The inner tube, below the stop-ring 10, is cylindrical and of uniform thickness up to the vicinity of the sealing ring 35. In this zone, the outer perimeter of the inner tube presents a truncated conical section 40, ending in a cylindrical section 41. The inner diameter of the lower element, above the aperture 23, is several millimeters greater than the outer diameter of the inner tube, ensuring continuity of the pressure-equalization passage.

The equalization passage, providing communication between the space below the valve and the space above it, consists of the apertures 23, kept shut by their valves 26 when the stop-valve is closed, and opened by the action of the truncated conical surface 40 on the needle 26′, the clear space between the outer surface of the inner tube 8 and the inner surface of the outer casing 6, in particular the part of this space providing a receptacle for the spring 9, the passage between the truncated conical bearings 38 and 39, and finally the aperture 37.

The surfaces of the various threaded sections, for assembly of the upper, middle and lower elements of the outer casing, and those used to attach the valve to the anchoring tool, or for handling the anchoring tool, are given anti-seizing surface treatment after manufacture.

In the present embodiment, one double seal 12 on the outer casing is located on the upper element, and the other double seal 22 on the lower element. In other embodiments, the seal 22 may be located on the middle or upper element, below the aperture 13. The outer perimeter of the outer casing can be altered in any way to allow the stop-valve to be used in any type of receptacle.

The stop-valve is placed in position, even at considerable depths, and in particular a few meters below ground-level for wells at sea, by using a known anchoring tool, with operating rods controlled from the surface; in addition, the size and weight of the stop-valve (approximately 62 kg) allow it to be placed in position by means of a cable at any depth.

In both cases, the stop-valve is inserted into the well and placed in position in its receptacle under pressure, with the flap-valve closed.

The hydraulic circuit is pressurized from the surface, to check that seals 20 and 22, and seals 19 and 20, are tight.

Pressurizing of the hydraulic circuit from the surface allows the valves 26 controlling the inlet to the equalization passage to be tested. If one of these valves is not tight, the pressure needed to initiate equalization is above normal, since the pressure of the well is transmitted into the main-spring receptacle.

When the hydraulic pressure applied attains the value required to compress the main-spring, the stop-valve opening process begins.

The first movement of the inner tube 8 results in a break in contact between the truncated conical surfaces 38 and 39, thereby providing communication between the receptacle of spring 9 and the space above the valve. Displacement of the inner tube 8 downwards brings the needle 26′ into contact with the truncated conical surface 40, which gradually pushes it outwards, opening the apertures 23.

The flow of fluid through the four apertures 23 in the embodiment described here is less than through a crown with the same diameter as the stop-valve. This moderation in the speed of pressure equalization offers certain advantages for the functioning of the equipment.

The lower end of the inner tube 8 comes into contact with the flap-valve 31 when equalization is completed, and by continuing its movement it then pushes the flap-valve 31 into a vertical position, which is reached while blocking of the flap-valve by the inner tube is still only partial.

This allows displacement of the inner tube to be reduced, with a corresponding reduction in the size of the upper lining 6*a*, saving weight and space.

The weight of the valve, together with the anchoring tool, is approximately 75 kg, for a total length of 117 cm.

To keep the safety stop-valve open, the force exercised by the pressure in the hydraulic circuit 15, and therefore the hydraulic chamber 16, on the effective surface-area 17 of the piston 18 must be greater than an opposing force equal to the sum of two components, one of which is the strength of the spring 9, and the other the product of the pressure in the well by the annular surface-area 18*a* on which it acts. In the embodiment illustrated, the annular surface-area 18*a* is equal to the effective surface-area 17 of the piston 18.

Pressure in the hydraulic circuit is normally controlled by monitoring the operating parameters of the well, notably well-head pressure.

A drop in pressure at the well-head below an "alarm" level thus releases the hydraulic circuit into the atmosphere, so that pressure drops and the inner tube rises, as a result of the opposing force. Immediately, the flap-valve 31, operated by the release spring 33, rotates, and presses against its seat 34. The inner tube 8, completing its upward movement, causes closure of the apertures 23, interrupting the pressure-equalization passage, and resulting in contact between the two truncated conical surfaces 38 and 39, which provide the second seal on the equalization passage. This double sealing device allows a check to be made at any time on whether the inlet apertures of the equalization passage are hermetic, and accordingly, by the difference, to see at any time whether pressure occurring above the shut stop-valve results from a valve leak or a leak in the equalization passage inlets. This means that the safest way of repairing the valve can be selected.

Stop-valves fitted with a double safety device on the equalization passage, designed in such a way that an inlet leak can be traced when hydraulic control is used, provide the very high level of safety required on wells at sea, where large-diameter production tubing is used, in particular above 150 millimeters.

What is claimed is:

1. In a hydraulic safety valve for controlling fluid flow in a tubing string in a well for extracting fluid under pressure, said valve comprising:

an outer casing having a longitudinal bore therethrough for flow of fluids;

a valve secured at the lower end of said casing for movement between open and closed positions for controlling the flow of fluids into said bore of said casing;

an inner tube supported for longitudinal movement in said casing between upper and lower positions, a lower end of said inner tube being engageable with said valve for moving said valve from a closed to an open position as said inner tube is moved from its upper to its lower position;

means associated with said inner tube for biasing said tube upwardly toward said upper position;

hydraulic means for urging said inner tube downwardly to said lower position;

a pressure equalizing passage extending through longitudinally spaced apertures in said inner tube and outer casing respectively and through a chamber between said inner tube and outer casing which connects said apertures to equalize the pressure across said valve when said passage is open;

an upper valve for closing said passage comprising two sealing surfaces forming integral parts of said outer casing and inner tube respectively, said surfaces being in sealing engagement when said inner tube is in its upper position, and a lower valve comprising means actuated by longitudinal movement of said inner tube for closing the aperture in said outer casing when said inner tube is in its upper position and for opening the aperture in said outer casing as said inner tube moves to its lower position, for the sealing surfaces forming said first seal have separated;

the improvement according to which said upper valve is located nearer the aperture in said inner tube than said lower valve and separation of said sealing surfaces is resisted by the pressure prevailing in said passage between said upper and lower valves, whereby leakage through the aperture in said outer casing past said lower valve is indicated by an increase in the pressure required to separate said sealing surfaces.

2. A safety valve as claimed in claim 1 in which said means for closing the aperture in said outer casing comprise a valve member, a seat in said aperture, spring means urging said valve member against said seat, a needle projecting from said valve member away from said seat and toward said inner tube, and a frustoconical surface on said inner tube which engages said needle as said tube descends and thereby progressively urges said valve member toward said seat.

3. A safety valve as claimed in claim 4 in which the valve and the lower end of said casing is a flap-valve mounted to swing within a cage, and the lower end of said inner tube extends into said cage for between one-fourth and one-half the length of the cage when said inner tube is in its lower position, thereby holding said flap-valve against the side of said cage.

* * * * *